US010081905B2

(12) United States Patent
Herrild et al.

(10) Patent No.: US 10,081,905 B2
(45) Date of Patent: Sep. 25, 2018

(54) IRONING DEVICE

(71) Applicant: Modiron, LLC, Lakeville, MN (US)

(72) Inventors: Natalie Herrild, Lakeville, MN (US); Erik Nelson, Minneapolis, MN (US); Rohit Deokar, Minneapolis, MN (US); Arjun Dubhashi, Minneapolis, MN (US); Zofia Kaminski, Fall Creek, WI (US); Daniel R. Rude, Cottage Grove, MN (US); Kate Valind, Austin, TX (US)

(73) Assignee: Modiron, LLC, Minneapolis, MN (US)

( * ) Notice: Subject to any disclaimer, the term of this patent is extended or adjusted under 35 U.S.C. 154(b) by 49 days.

(21) Appl. No.: 15/110,942

(22) PCT Filed: Jan. 9, 2015

(86) PCT No.: PCT/US2015/010742

§ 371 (c)(1),
(2) Date: Jul. 11, 2016

(87) PCT Pub. No.: WO2015/106054

PCT Pub. Date: Jul. 16, 2015

(65) Prior Publication Data

US 2016/0340823 A1 Nov. 24, 2016

Related U.S. Application Data

(60) Provisional application No. 61/925,399, filed on Jan. 9, 2014.

(51) Int. Cl.

| | |
|---|---|
| ***D06F 75/30*** | (2006.01) |
| ***D06F 75/08*** | (2006.01) |
| ***D06F 75/26*** | (2006.01) |

(52) U.S. Cl.
CPC ..... *D06F 75/30* (2013.01); *D06F 75/08* (2013.01); *D06F 75/265* (2013.01)

(58) Field of Classification Search
CPC ..... D06F 75/30; D06F 75/26; D06F 75/08; D06F 75/265; D06F 75/14; D06F 75/18; D06F 75/24; D06F 75/28; D06F 75/38; D06F 75/34
See application file for complete search history.

(56) References Cited

U.S. PATENT DOCUMENTS

| | | | |
|---|---|---|---|
| 824,742 | A | 7/1906 | Richardson |
| 999,581 | A | 8/1908 | Mills |
| 984,673 | A | 2/1911 | House |

(Continued)

FOREIGN PATENT DOCUMENTS

| | | | |
|---|---|---|---|
| KR | 10-1336138 | B1 | 6/2013 |
| WO | 1996024233 | A1 | 8/1996 |
| WO | 2013077608 | A1 | 5/2013 |

*Primary Examiner* — Ismael Izaguirre
(74) *Attorney, Agent, or Firm* — Grumbles Law PLLC; Brittany Nanzig

(57) ABSTRACT

An electrically-powered ironing device having a sole plate on an upper arm and a sole plate on a lower arm, wherein the arms can be moved into different positions to allow a user various ways of using the device. More specifically, the ironing device includes two arms, at least two sole plates with at least one sole plate located on each arm, a plurality of heat settings, a hinge connecting the two arms together, and a power source.

9 Claims, 15 Drawing Sheets

(56) References Cited

U.S. PATENT DOCUMENTS

| | | | | |
|---|---|---|---|---|
| 996,821 | A | 7/1911 | Wulff | |
| 999,601 | A | 8/1911 | Schweiner | |
| 1,010,891 | A | 12/1911 | Gamble | |
| 1,055,793 | A | 3/1913 | Pogue | |
| 1,095,925 | A | 5/1914 | Pogue | |
| 1,139,069 | A | 5/1915 | Pfanstiehl | |
| 1,313,124 | A | 8/1919 | Seldin | |
| 1,347,224 | A | 7/1920 | Kako | |
| 1,393,888 | A | 10/1921 | Farnsworth | |
| 1,465,838 | A | 8/1923 | Caneavri | |
| 1,485,193 | A | 2/1924 | McKay | |
| 1,498,654 | A | 6/1924 | Hauptman | |
| 1,584,974 | A | 5/1926 | Bradbury | |
| 1,710,037 | A | 4/1929 | Topinka | |
| 1,710,511 | A | 4/1929 | David | |
| 1,731,522 | A | 10/1929 | Carlson | |
| 1,836,045 | A | 12/1931 | Siers | |
| 1,858,851 | A | 5/1932 | Buchanan | |
| 1,926,987 | A | 9/1933 | Durham | |
| 1,950,498 | A | 3/1934 | Lehnen | |
| 2,056,951 | A | 10/1936 | Bailey | |
| 2,066,328 | A | 1/1937 | Cameron | |
| 2,076,614 | A | 4/1937 | Bowman | |
| 2,134,462 | A | 10/1938 | Powell | |
| 2,198,924 | A | 4/1940 | Smith | |
| 2,241,067 | A | 5/1941 | Hansen | |
| 2,258,844 | A | 10/1941 | Brown et al. | |
| 2,292,380 | A | 8/1942 | Kersten | |
| 2,299,462 | A | 10/1942 | Clark et al. | |
| 2,317,406 | A | 4/1943 | Ryan | |
| 2,384,644 | A | 9/1945 | Schreyer | |
| 2,406,490 | A | 8/1946 | Day | |
| 2,419,655 | A | 4/1947 | Reiser | |
| 2,433,901 | A | 1/1948 | Hayashi | |
| 2,441,817 | A | 5/1948 | Huff | |
| 2,458,530 | A | 1/1949 | Resnick | |
| 2,461,006 | A | 2/1949 | Sowers | |
| 2,484,899 | A | 10/1949 | Mayo | |
| 2,528,019 | A | 10/1950 | Storm | |
| 2,535,171 | A | 12/1950 | Sundstorm | |
| 2,601,059 | A | 6/1952 | Rotheraine | |
| 2,647,664 | A | 8/1953 | Palmatier | |
| 2,648,757 | A | 8/1953 | Harper | |
| 2,736,789 | A | 2/1956 | Cornellier | |
| 2,748,511 | A | 6/1956 | Pezza | |
| 2,750,692 | A | 6/1956 | Finlayson | |
| 2,750,695 | A | 6/1956 | Swenson | |
| 2,757,465 | A | 8/1956 | Myers | |
| 2,763,075 | A | 9/1956 | Vance | |
| 2,792,977 | A | 5/1957 | Klein | |
| 2,807,896 | A | 10/1957 | Tay | |
| 2,849,736 | A | 9/1958 | Kohle | |
| 3,068,598 | A | 12/1962 | Johnston | |
| 3,074,192 | A | 1/1963 | Smith | |
| 3,092,707 | A | 6/1963 | Wirth | |
| 3,121,781 | A | 2/1964 | Schoenwald | |
| 3,395,469 | A | 8/1968 | Gilbert | |
| 3,423,966 | A | 1/1969 | Mitchell | |
| 3,445,052 | A | 5/1969 | Lewallen | |
| 3,449,846 | A | 6/1969 | Bricker | |
| 3,458,794 | A | 7/1969 | Bohnstedt et al. | |
| 3,534,392 | A | 10/1970 | Trouilhet | |
| 3,577,859 | A | 5/1971 | Davidson | |
| 3,578,947 | A | 5/1971 | McNair | |
| 3,581,056 | A | 5/1971 | Djenner | |
| 3,690,024 | A | 9/1972 | Leonard | |
| 3,703,042 | A | 11/1972 | Smith | |
| 3,706,146 | A | 12/1972 | Anderson | |
| 3,742,629 | A | 7/1973 | Plasko | |
| 3,790,043 | A | 2/1974 | Hagen | |
| 3,793,753 | A | 2/1974 | Engelbart | |
| 3,811,208 | A | 5/1974 | Vieceli | |
| 3,934,114 | A | 1/1976 | Godel | |
| 3,950,052 | A | 6/1976 | Maloof | |
| 3,963,291 | A | 6/1976 | Maloof | |
| 3,973,528 | A | 8/1976 | Springer | |
| 3,997,759 | A | 12/1976 | LeBaigue | |
| 2,687,157 | A | 1/1977 | Cowan | |
| 4,000,569 | A | 1/1977 | Carson | |
| 4,003,616 | A | 1/1977 | Springer | |
| 4,004,596 | A | 1/1977 | Hyland | |
| 4,032,747 | A | 6/1977 | Kunz | |
| 4,034,201 | A | 7/1977 | Walter | |
| 4,075,458 | A | 2/1978 | Moyer | |
| D247,544 | S | 3/1978 | Gustavsson | |
| 4,101,757 | A | 7/1978 | Miller et al. | |
| 4,190,762 | A | 2/1980 | Decker | |
| 4,191,793 | A | 3/1980 | Gibson | |
| 4,196,340 | A | 4/1980 | Evans | |
| 4,206,340 | A | 6/1980 | LeBaigue | |
| 4,215,264 | A | 7/1980 | Hetherington | |
| 4,219,724 | A | 8/1980 | Allvin | |
| 4,358,660 | A | 11/1982 | Andis | |
| 4,366,365 | A | 12/1982 | Kunz | |
| 4,577,424 | A | 3/1986 | Liu | |
| 4,636,613 | A | 1/1987 | Bressler et al. | |
| 4,651,453 | A | 3/1987 | Doyle | |
| 4,688,340 | A | 8/1987 | Ostrelich | |
| 4,739,151 | A | 4/1988 | Smal | |
| 4,810,855 | A | 3/1989 | Dassi | |
| 4,815,441 | A | 3/1989 | Schawbei | |
| 4,817,309 | A | 4/1989 | Karlheinz | |
| 4,819,350 | A | 4/1989 | Engel | |
| 4,845,868 | A | 7/1989 | Birkett | |
| 4,870,250 | A | 9/1989 | Leung et al. | |
| 4,910,894 | A | 3/1990 | Vartan | |
| 4,995,177 | A | 2/1991 | Burton | |
| 4,998,360 | A | 3/1991 | Lee | |
| 5,014,453 | A | 5/1991 | Gratsch | |
| 5,152,569 | A | 10/1992 | Guiboche | |
| 5,299,372 | A | 4/1994 | Bradley | |
| 5,357,988 | A | 10/1994 | Nakamura | |
| 5,414,945 | A | 5/1995 | de Blois et al. | |
| 5,526,596 | A | 6/1996 | Bitzel et al. | |
| D376,232 | S | 12/1996 | Villar | |
| 5,613,310 | A | 3/1997 | Jimenez et al. | |
| 5,642,578 | A | 7/1997 | Hazan et al. | |
| 5,651,201 | A | 7/1997 | Farley | |
| 5,664,588 | A | 9/1997 | Berry | |
| D388,576 | S | 12/1997 | Brun | |
| 5,721,418 | A | 2/1998 | Hazan | |
| 5,732,489 | A | 3/1998 | Udelle | |
| 5,883,358 | A | 3/1999 | Brandolini | |
| 5,901,481 | A | 5/1999 | Simmons | |
| 5,909,964 | A | 6/1999 | Johns | |
| 5,934,293 | A | 8/1999 | Kaizuka | |
| 5,957,140 | A | 9/1999 | McGee | |
| 5,971,235 | A | 10/1999 | Chanek | |
| 6,032,391 | A | 3/2000 | Yao | |
| 6,119,702 | A | 9/2000 | Habibi | |
| 6,173,718 | B1 | 1/2001 | Okumoto et al. | |
| 6,191,387 | B1 * | 2/2001 | Smal | A45D 2/001 132/224 |
| 6,216,369 | B1 | 4/2001 | Wolf et al. | |
| 6,223,753 | B1 * | 5/2001 | Lo | A45D 2/001 132/224 |
| 6,243,976 | B1 | 6/2001 | Beverly | |
| D445,540 | S | 7/2001 | Hirata | |
| 6,260,295 | B1 | 7/2001 | Nickel | |
| 6,325,072 | B1 | 12/2001 | Smetana | |
| 6,399,919 | B1 | 6/2002 | Wu | |
| 6,421,939 | B1 | 7/2002 | David | |
| D467,051 | S | 12/2002 | Marbury | |
| 6,494,216 | B1 | 12/2002 | Hirata | |
| 6,513,269 | B2 | 2/2003 | Kobayashi et al. | |
| 6,539,651 | B1 | 4/2003 | Rius et al. | |
| 6,539,652 | B1 | 4/2003 | Barry | |
| 6,548,785 | B1 * | 4/2003 | Rius | D06F 75/26 116/101 |
| 6,622,735 | B2 | 9/2003 | Hirata | |
| 6,625,910 | B2 | 9/2003 | Ching | |
| 6,645,392 | B2 | 11/2003 | Frankenbach et al. | |
| 6,652,766 | B1 | 11/2003 | Frankenbach et al. | |

(56) References Cited

U.S. PATENT DOCUMENTS 6,653,599 B2 * 11/2003 Nam ..... A45D 1/04 132/224
6,667,462 B2 12/2003 Lo
6,782,636 B2 8/2004 Feldman
6,820,359 B2 11/2004 Muijadi
6,857,209 B2 2/2005 Wehrwein et al.
RE38,713 E 3/2005 Habibi
7,121,024 B1 10/2006 Clevenberg
7,127,840 B2 10/2006 McCabe
7,178,531 B2 2/2007 Carballada et al.
7,188,442 B2 3/2007 Fernandez
D551,388 S 9/2007 Kuchler et al.
7,380,556 B2 6/2008 Carballada et al.
7,389,597 B1 6/2008 Chen
7,409,786 B2 8/2008 Lee
7,445,012 B2 11/2008 Mukai
7,600,520 B2 10/2009 Choi
7,637,041 B2 12/2009 Pan et al.
7,640,686 B2 1/2010 Wai
7,690,139 B2 4/2010 Germain et al.
7,716,858 B2 5/2010 Lin
7,735,416 B2 6/2010 Ekberg
7,908,776 B2 3/2011 Ng et al.
8,071,915 B2 12/2011 Mukai
8,080,764 B2 12/2011 Shami
8,112,917 B1 2/2012 Tameo
8,136,274 B2 3/2012 Blana et al.
8,141,279 B2 3/2012 Gamble
8,151,496 B2 4/2012 Lee et al.
8,166,682 B2 5/2012 Pan
8,230,868 B2 7/2012 Choi
8,237,090 B2 8/2012 Ng et al.
8,272,152 B2 9/2012 Fernandez
D670,044 S 10/2012 Andreesen
8,276,297 B2 10/2012 Fabrikant
8,286,645 B2 10/2012 Kyu
8,353,303 B2 1/2013 Kim
8,365,446 B2 2/2013 Ng et al.
8,375,609 B2 2/2013 Harrington
8,375,610 B2 2/2013 Bearley
8,393,093 B2 3/2013 Cleveland
8,407,920 B2 4/2013 Draghiceanu
8,541,715 B2 9/2013 Overend et al.
8,544,477 B1 10/2013 Laaly
9,528,220 B2 * 12/2016 Dierker ..... D06F 75/30
2001/0030183 A1 10/2001 Bowen
2003/0070331 A1 4/2003 Chen
2005/0011533 A1 1/2005 Ruben
2005/0028408 A1 2/2005 Tobias
2008/0168687 A1 7/2008 Pan et al.
2008/0173322 A1 7/2008 Leung
2009/0205229 A1 8/2009 Wai
2009/0223097 A1 9/2009 Lee
2009/0260651 A1 10/2009 Chan
2009/0301509 A1 * 12/2009 Leung ..... A45D 1/06 132/269
2010/0043259 A1 2/2010 Janakiraman et al.
2010/0212683 A1 * 8/2010 Mizuno ..... A45D 1/04 132/223
2011/0139172 A1 6/2011 Da Silva
2012/0312319 A1 * 12/2012 Uwano ..... A45D 2/001 132/211

* cited by examiner

VISUAL TEMPERATURE GUIDE

IRONING DEVICE

CROSS-REFERENCE TO RELATED APPLICATIONS

This application claims the benefit of U.S. Provisional Application No. 61/925,399, filed Jan. 9, 2014, titled IRONING DEVICE.

FIELD OF THE DISCLOSURE

The disclosed invention relates to an ironing device with two soleplates that is lightweight and portable and can be used in several different positions, using one or both soleplates to apply heat to a surface or fabric.

BACKGROUND OF THE INVENTION

Current ironing devices are traditionally used in the home and are utilized to remove creases from a fabric. Further, they typically require a firm, heat-resistant surface, such as an ironing board, to press the fabric against, they have one soleplate on the bottom surface, and are heavy. While these features work well for a user in a location where an ironing board can be used, such as a house or hotel, numerous people travel frequently for reasons such as work or pleasure and do not have access to an ironing device or, even if they have access, do not have the ability, or desire, to use a heavy ironing device to keep their clothes smooth and wrinkle-free. For example, a user on a business trip may want to quickly smooth out portions of the user's shirt prior to a meeting, but the hotel may not have an iron in the room or the user may already be at the meeting location and, therefore, not have access to an iron. Therefore, an ironing device is needed that is small and light enough to be portable and that does not require use of an ironing board.

SUMMARY OF THE INVENTION

The present disclosure relates to an electrically-powered ironing device with two soleplates that can be used as an alternative and/or supplemental solution to current ironing products. The device is multi-functional and has multiple heat settings to allow for temperature control by a user. The device is versatile, and various versions of it can be used in several different positions, using both soleplates or using only one of the soleplates to apply heat to a surface or fabric.

Reference is made throughout the present disclosure to certain aspects of one embodiment of the ironing device described herein. Such references to aspects of the presently described device do not limit the scope of the claimed invention. Additionally, any examples set forth in this disclosure are not intended to be limiting and merely set forth some of the many possible embodiments for the disclosed ironing device. It is to be understood that the phraseology and terminology used herein are for the purpose of description and should not be regarded as limiting.

DETAILED DESCRIPTION

Figure 1:
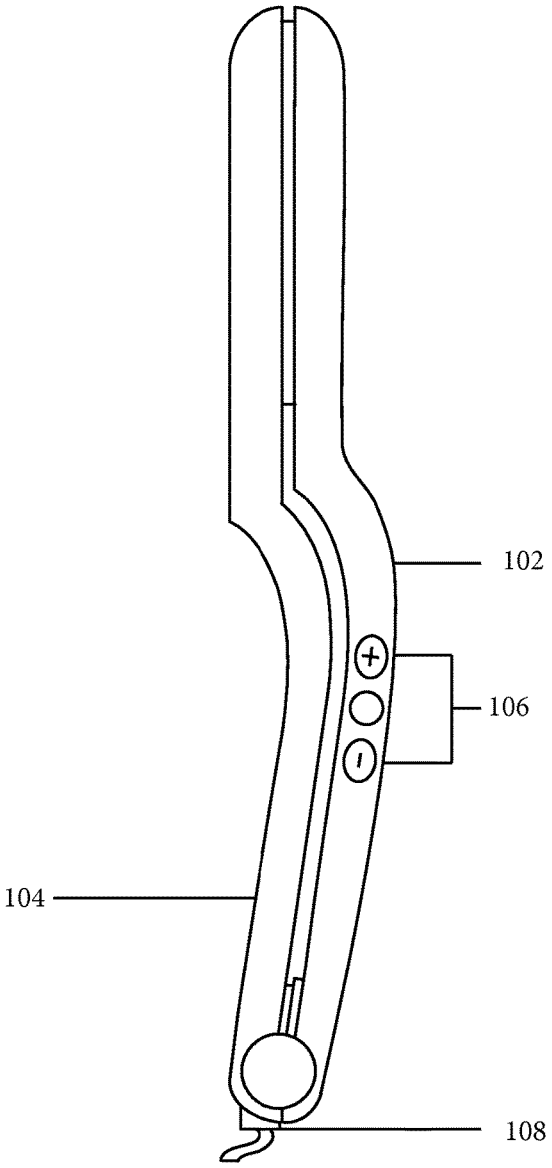
FIG. 1 is a left side view of one embodiment of the ironing device.

Various embodiments will be described in detail with reference to the drawings, wherein like reference numerals represent like parts and assemblies throughout the several views. Reference to various embodiments does not limit the scope of the claimed invention. Additionally, any examples set forth in this specification are not intended to be limiting and merely set forth some of the many possible embodiments for the described invention. It is understood that various omissions and substitutions of equivalents are contemplated as circumstances may suggest or render expedient, but these are intended to cover applications or embodiments without departing from the spirit or scope of the claimed invention. Also, it is to be understood that the phraseology and terminology used herein are for the purpose of description and should not be regarded as limiting.

The presently disclosed device is a multi-functional ironing device to be used as an alternative and/or supplemental solution to current ironing products. It is mobile, small and lightweight. For example, in one embodiment the device weighs about one pound and two arms are twelve inches in length. Additionally, multiple heat settings, illustrated in one embodiment in FIGS. 4 and 5, allow for temperature control depending upon the surface or fabric being ironed. The ironing device uses a power supply, such as a power outlet, to begin the heating process. A user can then adjust the ironing device to the desired heat setting. All electrical parts, such as the heating elements and the sensors can receive suitable AC or DC supply voltages in a conventional manner.

In some embodiments, the disclosed device includes two soleplates that are heated with a heating element that is controlled by, for example, a conventional thermostat or an electronic control. In one embodiment, the heating element can be a thick film heater for controlled heating, but other heating element types can be used. The design of the first and second soleplates makes the user interface quick and effective for all ironing tasks. The size of the first and second soleplates combined with their ability to heat quickly and accurately allow for substantial surface area to be covered in a minimal amount of time. In some embodiments, the first and second soleplates are tapered to a point to facilitate workability around small details in fabric or seams in clothing.

The ultimate function of the disclosed ironing device is to give the user the option of convenient heating/ironing/pressing in two or more forms for their clothing, accessories, or fabric needs.

Figure 21:
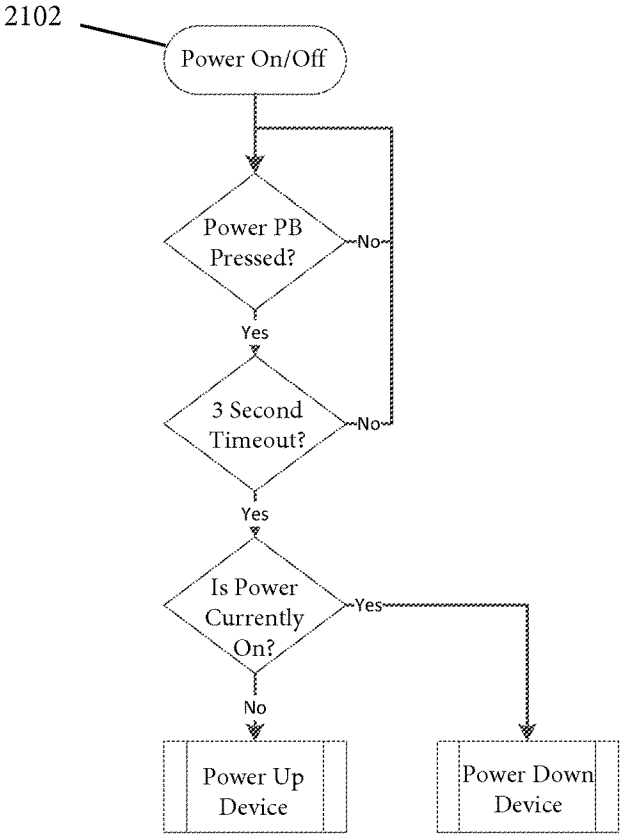
FIG. 21 is a flowchart illustrating the process of turning one embodiment of the ironing device on and off.

The device can be turned on using a button or switch, and can then be powered by an electric current. For example, as illustrated in FIG. 21, once a user presses the power button or switch 2102, the device can go through a series of checks to determine whether the device is on, and therefore, needs to be powered down, or whether the device is off and, therefore, needs to be powered up. In one embodiment, if the power button or switch 2102 is pressed, the device waits 3 seconds before taking any action. In some embodiments, the device also has a built-in power converter, which allows it to be used anywhere around the world. Once the device is electrically activated via the power cord, it begins heating the first and second soleplates via the heating element. The soleplates may be made of any heat conducting material as known in the art, such as ceramic, aluminum, titanium, or a para-amid synthetic fiber (for example: Kevlar). This heating occurs due to resistance built up along the course; the buildup changes from electrical energy to heat energy, thus causing the soleplates to emit heat and press wrinkles out of a clothing article or other surface.

The device uses a heating process known as Joule Heating, which can be calculated with the following equation:

$$(\text{heat energy})=(\text{electrical current})^2*(\text{resistance})*(\text{time})$$

As a result of this equation, it can be seen that in order for the device to become hot enough to smooth out wrinkled clothing it will need higher electrical current and resistance within the first and second soleplates. This current can be controlled by means such as, but not limited to, heat setting buttons, a regulatory wheel, or a slide control. Moving the control in a positive direction will increase electrical current, whereas moving the control in a negative direction will decrease electrical current. While electrical current is increasing or decreasing, resistance is set in the manufacturing stage by a selection of soleplate material, in this case ceramic, aluminum, titanium, or a para-amid synthetic fiber (for example: Kevlar).

Figure 20:
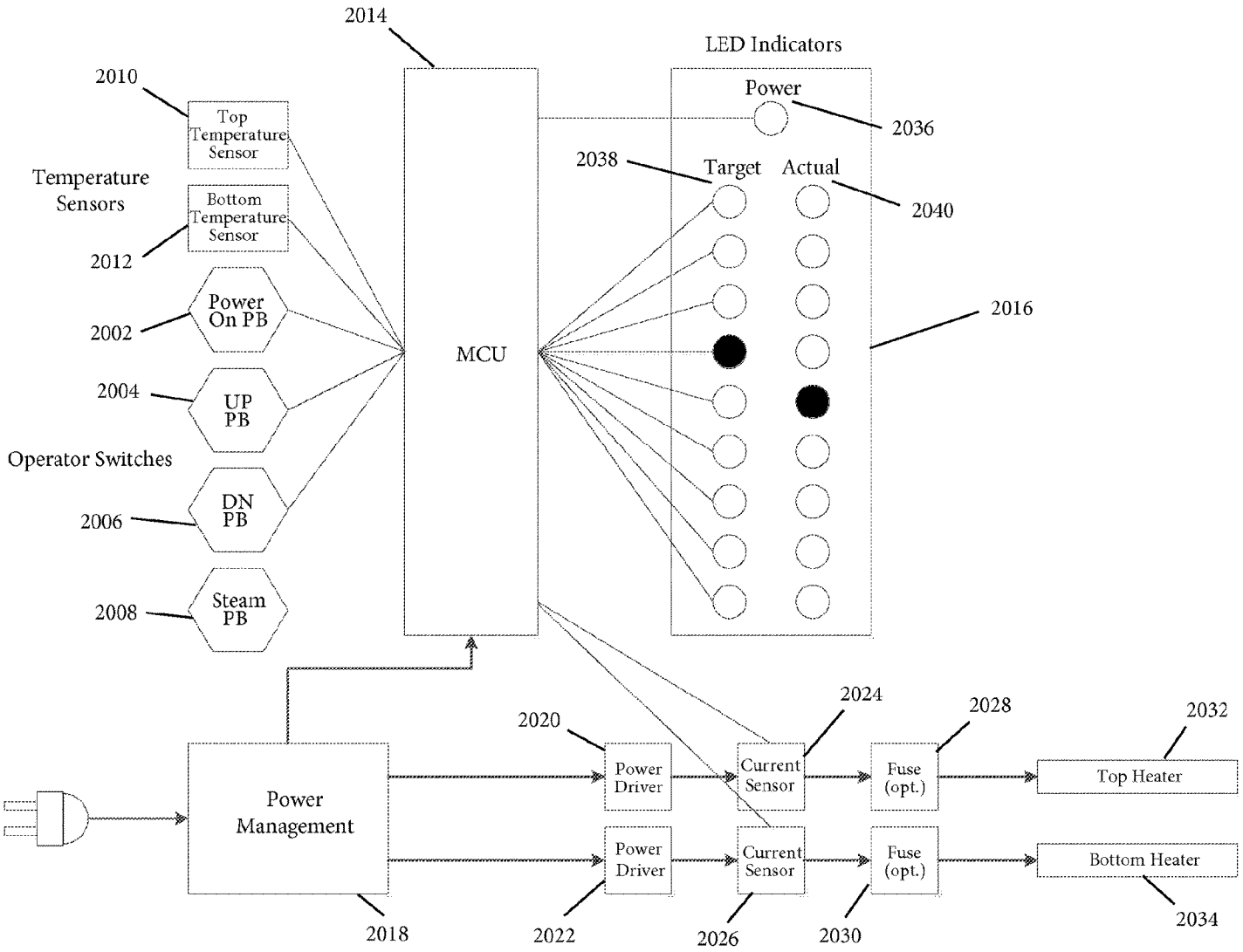
FIG. 20 is an electrical control system block diagram of one embodiment of the ironing device.

As illustrated in FIG. 20, the device can include several sensors and switches. For example, the user may have access to switches that turn the device on, such as a Power On Power Button (PB) 2002, an Up PB 2004, a Down PB 2006, and a Steam PB 2008. The device can have one temperature sensor or several, separate temperature sensors, a top soleplate temperature sensor 2010 and a bottom soleplate temperature sensor 2012 on the microcontroller (MCU) 2014, LED indicator lights 2016 on the MCU, and power management 2018 that includes, for the top and the bottom heating elements 2032, 2034, a power driver 2020, 2022, a current sensor 2024, 2026, and an optional fuse 2028, 2030. There can be LED indicator lights for features such as, but not limited to, an LED power light 2036, targeted temperature LED lights 2038, and actual temperature lights 2040. The targeted temperature LED lights 2038 and actual temperature lights 2040 can be aligned in a column with the lights towards the bottom of the column indicating a lower temperature and the lights toward the top of the column indicating a higher temperature. An alternative to LED indicator lights is a screen, such as a liquid crystal display (LCD) screen, wherein notifications such as, but not limited to, the current temperature, targeted temperature, and power status are displayed. In some embodiments, the sensors may be resistors with a positive temperature coefficient (PTC) or a negative temperature coefficient (NTC) of suitable dimensions. In other embodiments, a thermo-couple or a contactless infrared sensor may be used.

Figure 22:
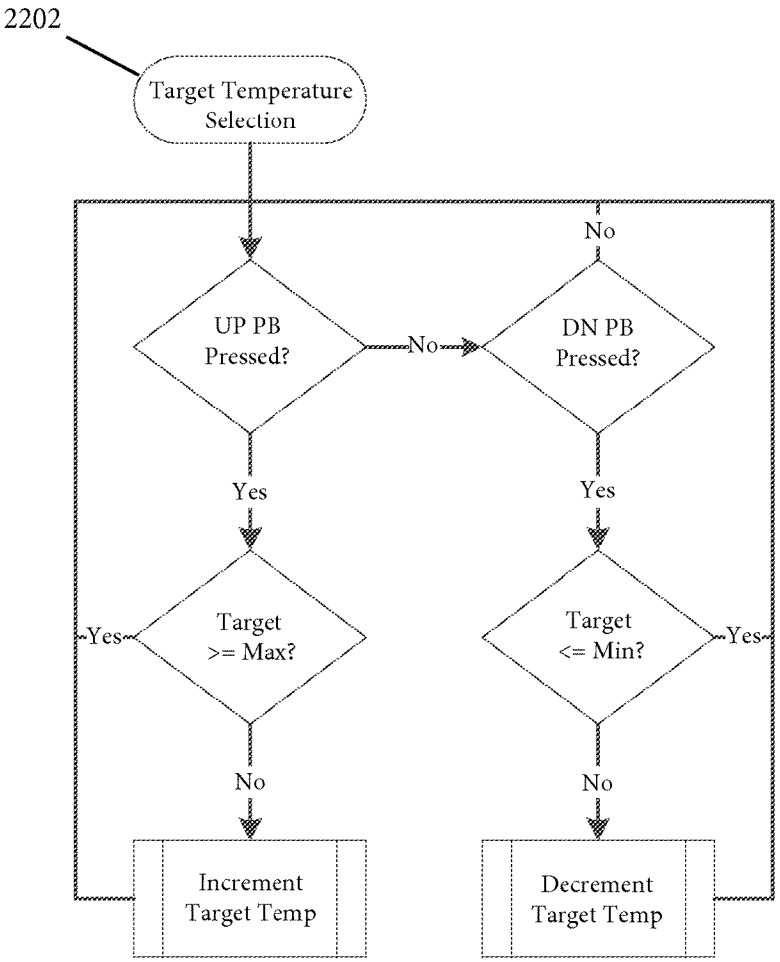
FIG. 22 is a flowchart illustrating the process of changing the temperature of one embodiment of the ironing device.

In some embodiments, the device can determine if a target temperature is attainable by the device. For example, as illustrated in FIG. 22, if the user has made a target temperature selection 2202 indicating a desired increase in temperature, the device can compare the user's targeted temperature to the maximum temperature attainable by the device and, if the targeted temperature is less than the maximum temperature, the device will increment the target temperature. Similarly, if the user has made a target temperature selection 2202 indicating a desired decrease in temperature, the device can compare the user's targeted temperature to the minimum temperature attainable by the device and, if the targeted temperature is greater than the minimum temperature, the device will decrement the target temperature.

Figure 23:
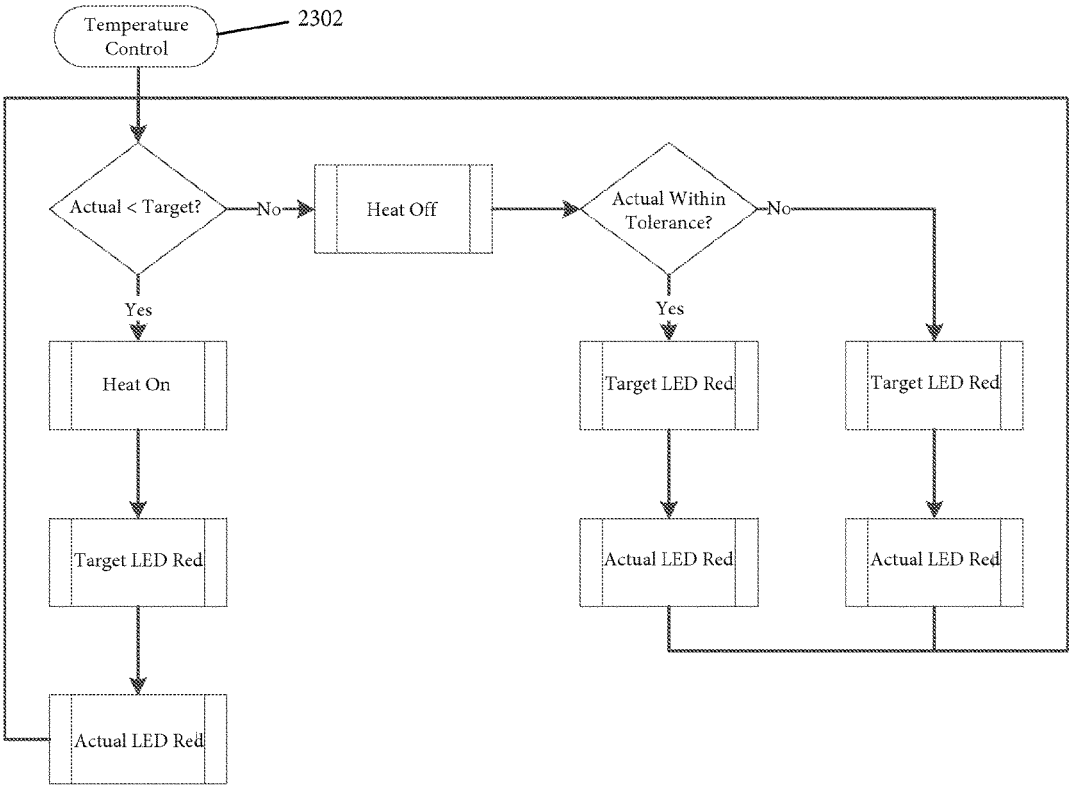
FIG. 23 is a flowchart illustrating the process of changing and indicating temperature levels of one embodiment of the ironing device.

In some embodiments, the device can check whether a target temperature selection has been reached and, if not, it can change the temperature. For example, as illustrated in FIG. 23, if the user has moved a temperature control 2302 indicating a desired increase in temperature, the device can then compare the actual temperature to the target temperature and, if it the actual temperature is less than the target temperature, the device will increase its heat output, indicate the targeted temperature to the user, and indicate the actual temperature to the user. Similarly, if the user has moved a temperature control 2302 indicating a desired decrease in temperature, the device can compare the actual temperature to the target temperature and, if the actual temperature is greater than the target temperature, the device will decrease its actual temperature.

Also illustrated in FIG. 23, if the user has moved a temperature control 2302 indicating a desired increase in temperature, the device can compare the actual temperature to the target temperature and, if the actual temperature is greater than or equal to the target temperature, the device will turn the heating elements off. It can then check to see if the actual temperature falls within a tolerance range and can indicate to the user the targeted and actual temperatures.

In some embodiments, the temperatures can be indicated to the user by having LED lights located next to a range of temperatures in two columns, as illustrated in FIG. 20. For example, if the user desires a temperature of 200 Celsius and the device is currently at 150 Celsius, the device can light up a targeted temperature LED light 2038 in the Target column next to a label of 200 Celsius, and the device can light up an actual temperature LED light 2040 in the Actual column next to a label of 150 Celsius. Therefore, the user will be aware that the user has selected a desired temperature of 200 Celsius and that the device is only at 150 Celsius.

Figure 24:
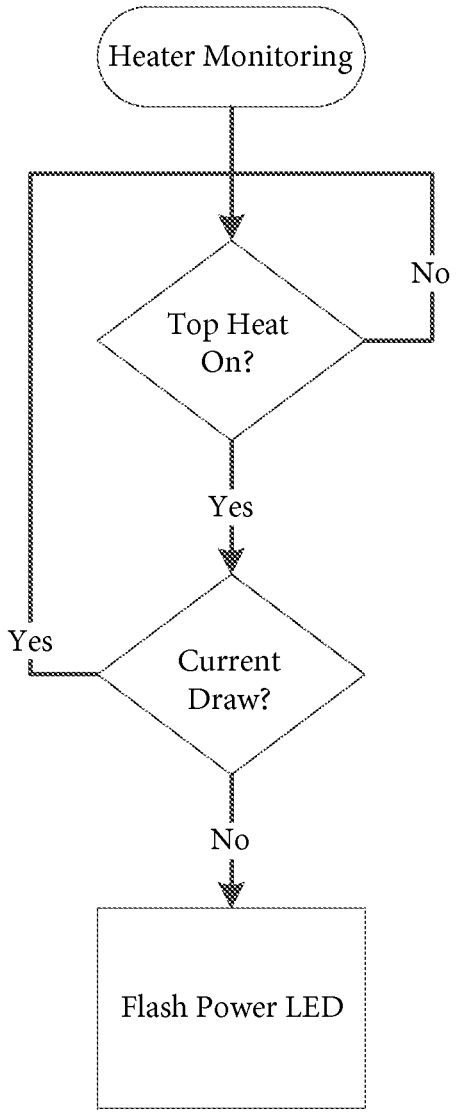
FIG. 24 is a flowchart illustrating the process of monitoring the heat of one embodiment of the ironing device.

As illustrated in FIG. 24, to monitor the heat, the device can continuously check to see whether the heat on a soleplate, such as the top soleplate, is on. If it is, the device can check to see if there is a current draw and, if not, it will flash a light next to the power switch. If there is a current draw, the device will continue the process of checking to see if the heat on a soleplate is on.

Figure 25:
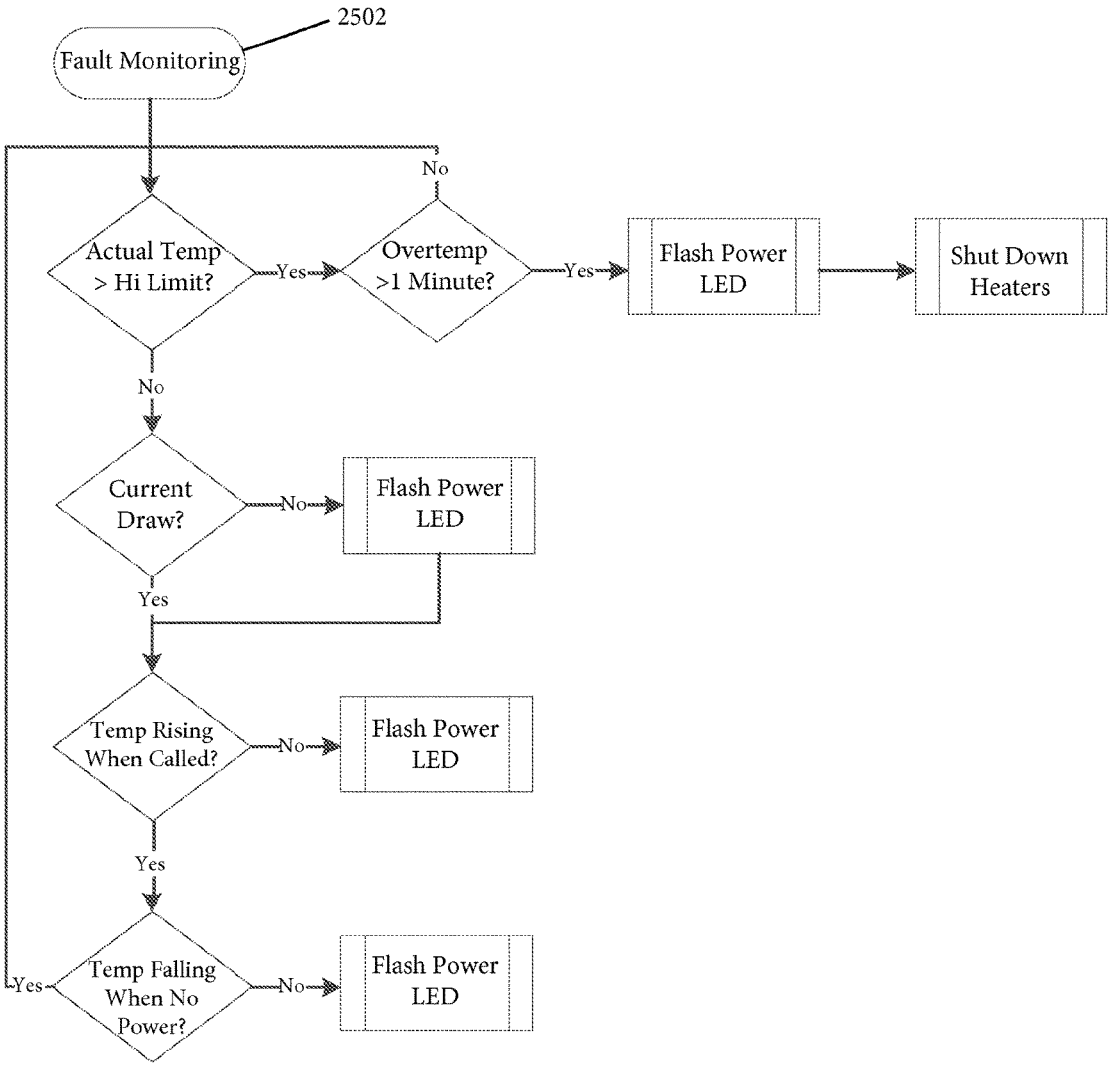
FIG. 25 is a flowchart illustrating the process of fault monitoring in one embodiment of the ironing device.

The device can also continuously check to see if a fault has occurred, as illustrated in FIG. 25. For example, to execute fault monitoring 2502, the device can have a high temperature limit and can compare the actual temperature to the high limit. If the actual temperature is higher than the high limit, it can check whether the device has been over the high limit for greater than 1 minute and, if so, can flash a light next to the power switch and shut down the heaters. If, after comparing the actual temperature to the high limit, the device determines that the actual temperature is not greater than the high limit, it can then check to see if there is a current draw. If there is a current draw, the device can check to see if the temperature of the device is rising. If there is no current draw, the device can flash a light next to the power switch and then check to see if the temperature of the device is rising. If the temperature is not rising, the device can flash a light next to the power switch and is the temperature is rising, the device can check to see if the temperature is falling when there is no power to the device. If the temperature is not falling when there is no power to the device, the device can flash a light next to the power switch. If the temperature is falling when there is no power to the device, the device can start its fault check over from the beginning.

The device can have a casing made from a solid material such as injection molded plastic. Soleplates can be attached to each end of the device. The soleplates, in some embodiments, can be made from a heat-conducting material, such as ceramic, aluminum, or titanium, with a non-stick smooth glide coating to prevent static and stickiness. The soleplates may include tourmaline to provide smoother ironing as well. The soleplates may come to a point at their ends for fine detail ironing work.

The present invention can be adapted to consumer needs or to meet a higher technical standard. Basic features that can be added or taken away would be a steam setting, strictly one-sided heat, a spring mechanism at the hinge, strict form arms, multiple plate heads, a split spring handle and more limited control settings. In some embodiments, the hinge or joint may be modified to allow the lower arm to be pulled around to meet the upper arm. This would create the same compactness when using only the one-sided heat option.

In some embodiments, the device has a first soleplate and a second soleplate that comprise an upper portion and a lower portion, one or both of which contain heating elements in the respective head that can be controlled by, for example, a conventional thermostat or an electronic control, and that can heat the soleplate. In one embodiment, the heating element can be a thick film heater for controlled heating. In some embodiments, the device will have a water reservoir for steam functionality that is located directly above or below one or both soleplates. In some embodiments, the device allows for attachment of a steam cloth or other water absorbent materials to one or both soleplates.

Configuration 1

Figure 2:
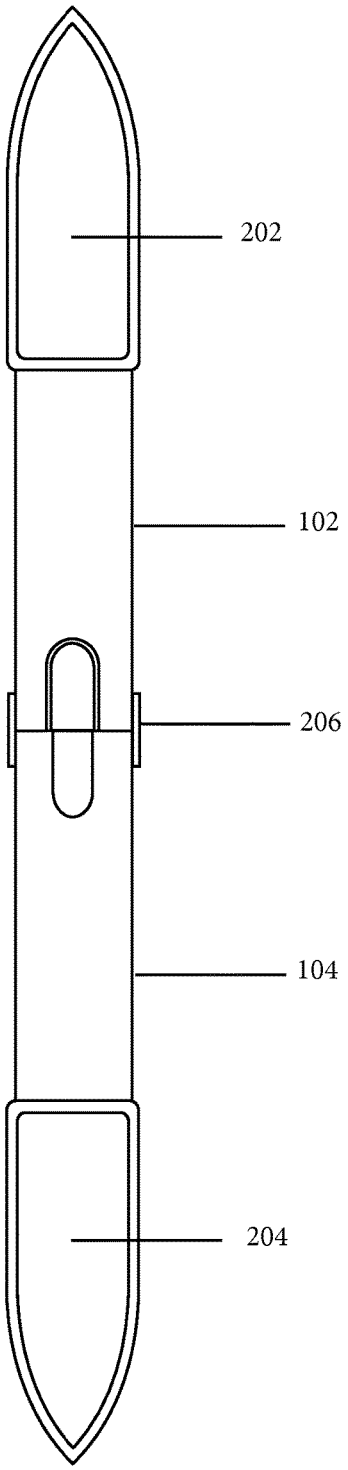
FIG. 2 is a front view of one embodiment of the ironing device wherein the device is shown in a fully open position.
Figure 3:
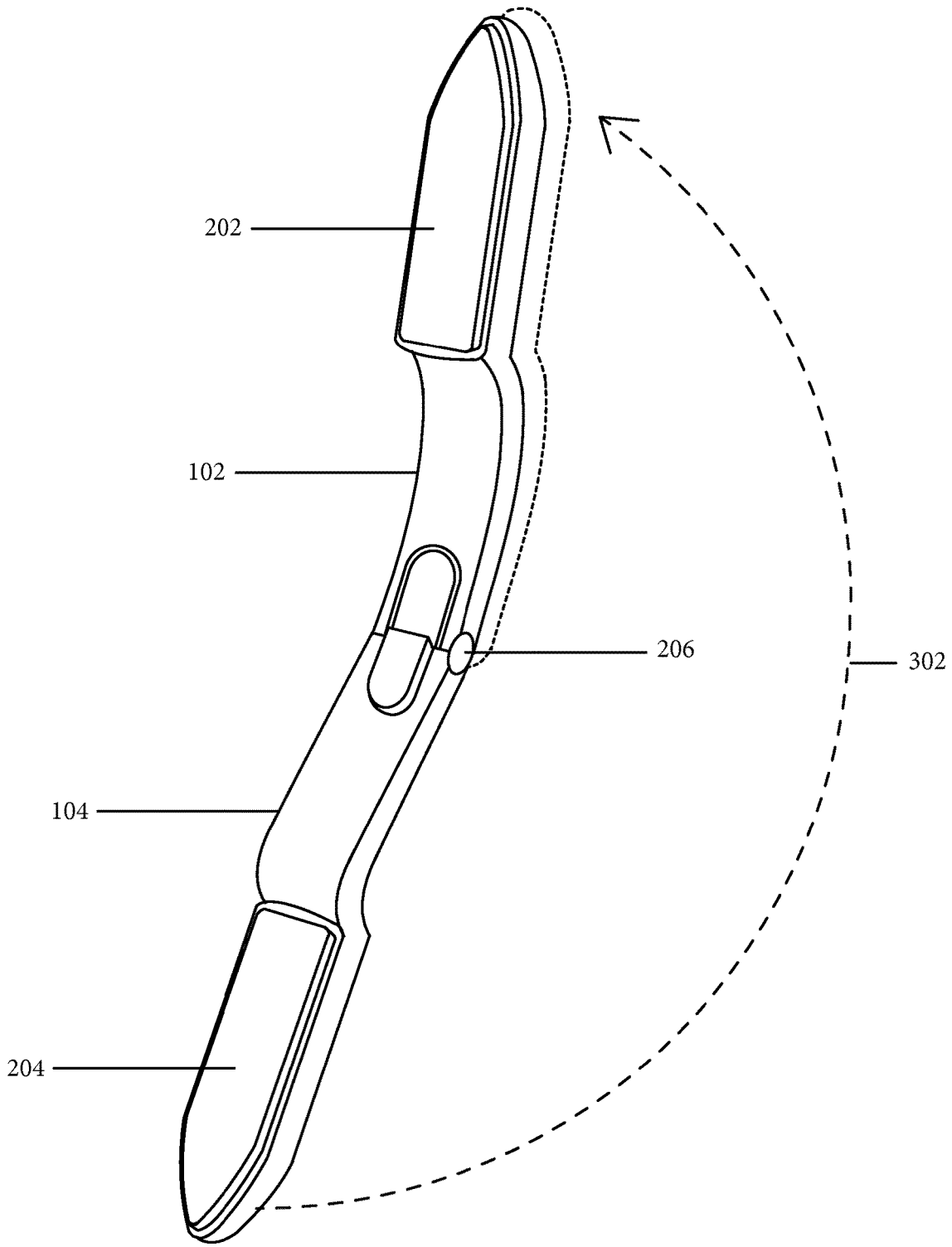
FIG. 3 is a perspective view of one embodiment of the ironing device wherein the device is shown in a fully open position.
Figure 7:
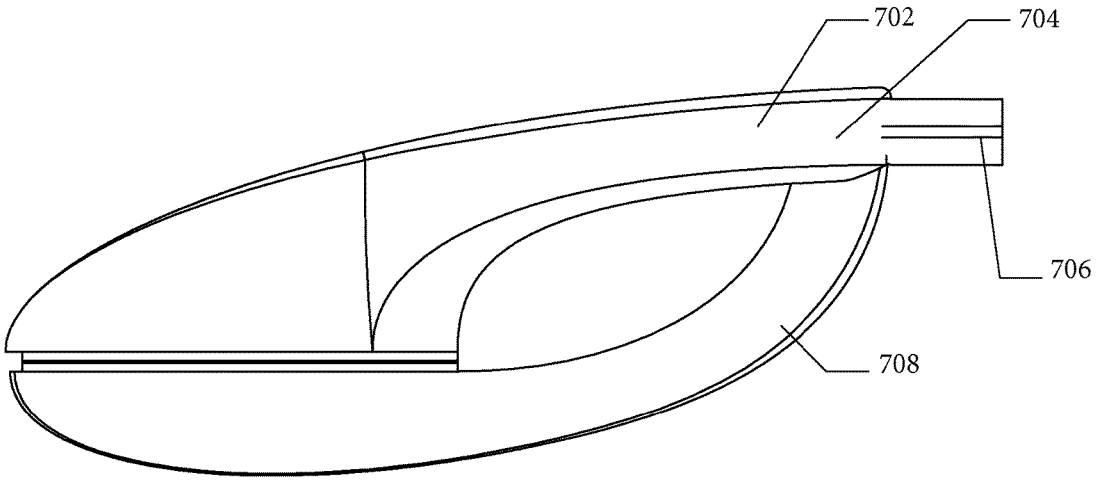
FIG. 7 is a left side view of one embodiment of the ironing device.
Figure 8:
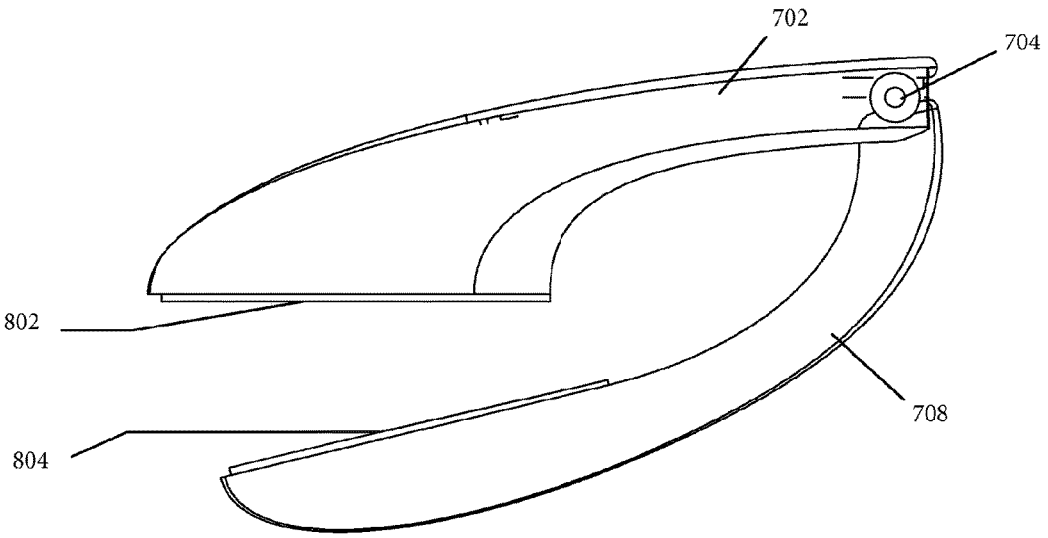
FIG. 8 is a perspective view of one embodiment of the ironing device wherein the device is shown in a partially open position.
Figure 9:
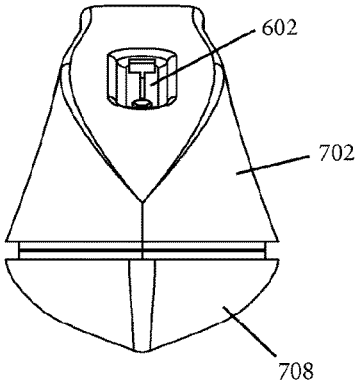
FIG. 9 is front view of one embodiment of the ironing device wherein the device is showed in a closed position.
Figure 10:
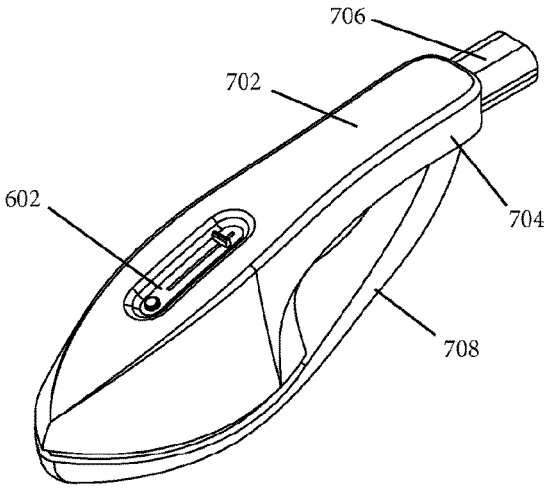
FIG. 10 is a perspective view of one embodiment of the ironing device wherein the device is shown in a closed position.
Figure 11:
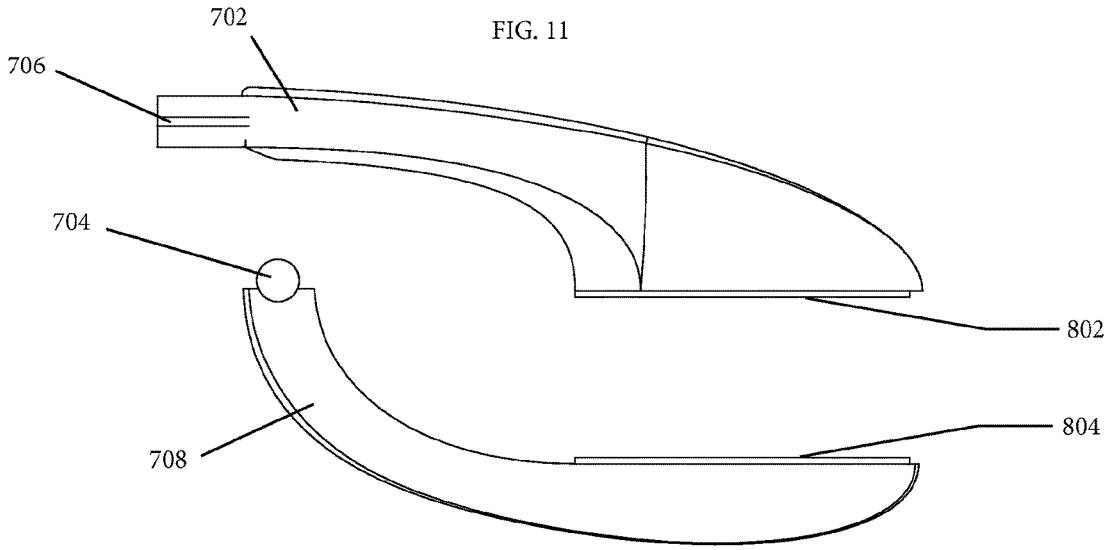
FIG. 11 is a perspective view of one embodiment of the device wherein the upper arm of the device has been removed from the lower arm of the device.

In one embodiment, the use of a hinge or joint 206, 704 between and connecting the upper arm 102, 702 and lower arm 104, 708 of the device permits the device to move from an open position, as illustrated in FIGS. 2 and 8, to a closed position, as illustrated in FIGS. 1 and 7. When the first soleplate 202, 802 and second soleplate 204, 804 are both functioning, the device must be in a closed position. This position is achieved by applying pressure to squeeze the upper arm 102, 702 and the lower arm 104, 708 of the device together. In this position, a thin surface (such as a piece of fabric or other material) may run between the plates. The heat from the plates, combined with the squeezing pressure, acts to remove wrinkles from material that is being pressed. If the device is used in its open position, only the heating element in the first soleplate 202, 802 will be on. For example, if a user rotates the second arm 104, 708 90 degrees or more away from the first arm 102, 702, the heating element in the second soleplate 204, 804 will be turned off even if the device is on. The hinge motion of the hinge or joint 206, 704 automatically disconnects the second soleplate 204, 804 from electric current, thus protecting the user from potential danger including burns. The device then functions similarly to a traditional household iron such that the user grips the upper arm 102, 702 or both the upper arm 102, 702 and the lower arm 104, 708 and applies downward pressure onto the surface to be pressed, with the first soleplate 202, 802 facing toward the surface, as illustrated in FIG. 2. In one embodiment, as illustrated in FIG. 3, the device has the ability to swing open up to 360 degrees 302. In one embodiment, the upper arm 102, 702 of the device can be removed from the lower arm 104, 708, as illustrated in FIG. 11, and used in conjunction with an ironing board or other flat surface. In this embodiment, the heating element in the second soleplate 204, 804 will no longer be on even though the heating element in the first soleplate 202, 802 will be on.

Figure 4:
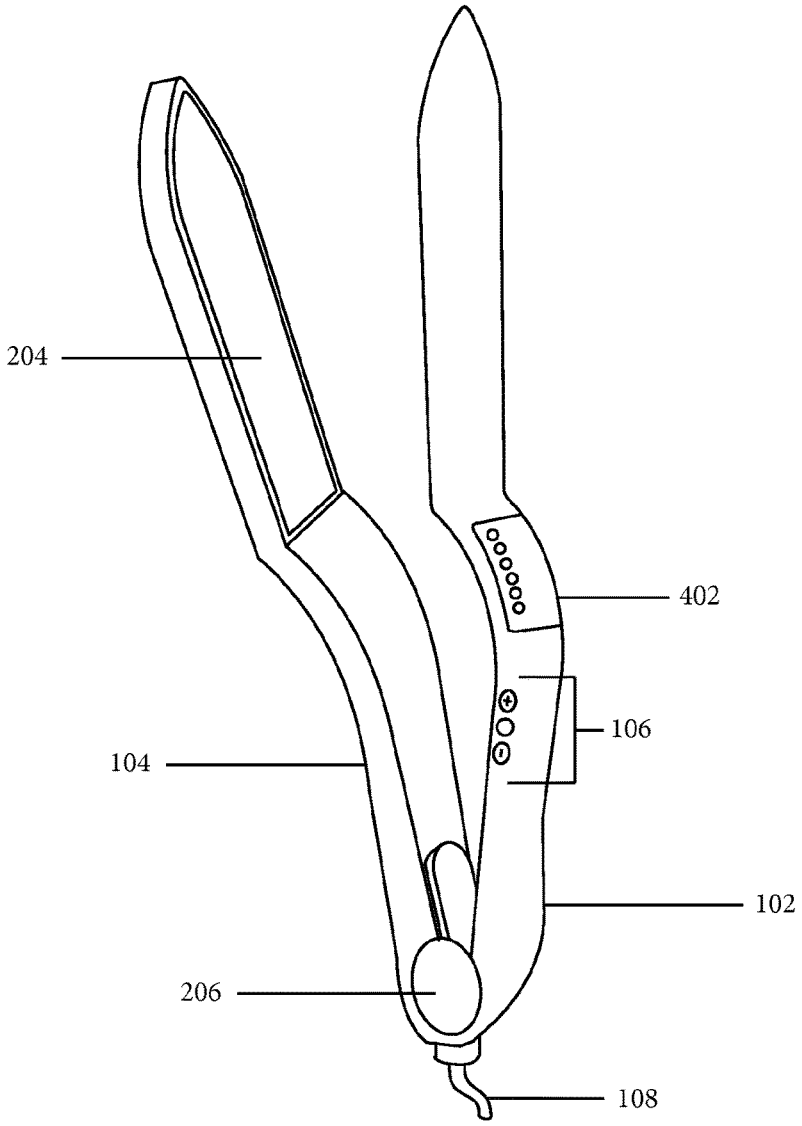
FIG. 4 is a perspective view of one embodiment of the ironing device wherein the device is shown in a partially open position.
Figure 5:
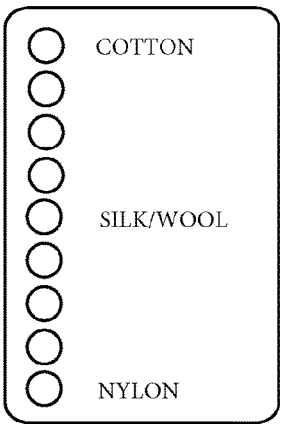
FIG. 5 is a close-up view of the visual temperature guide of the ironing device according to one embodiment of the device.
Figure 6:
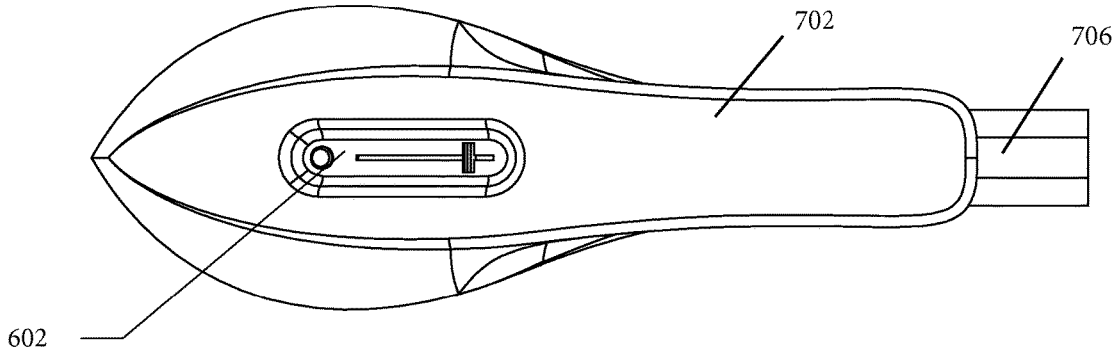
FIG. 6 is a top view of one embodiment of the ironing device.

The ironing device can have a graphic heat setting indicator that uses lights, words, or a combination of both to display how hot the device is, as illustrated in FIG. 4. In some embodiments, this may be indicated on a visual temperature guide 402 in terms of material rather than temperature, as illustrated in FIG. 5. The device can have several heat settings 106, 602, which can be controlled by, for example, buttons, a regulatory wheel, or a slide control on the device, and which can correlate to either the desired temperature of the device or the type of material to be ironed (such as cotton, silk/wool, and nylon). The device can also have an On/Off button and a steam control button or switch. In some embodiments, the device has the ability to reach around 420 degrees Fahrenheit with an instant heat feature, such as a 30-second instant heat, which allows for near immediate use. The ironing device can be connected to an electrical source via a length of electrical cord 108, 706, for example, a 12-foot cord with 360-degree swivel capabilities 302, allowing the user to iron in any position. It can also have a polarized plug for safety.

Some embodiments of the ironing device may be equipped with an automatic shutoff feature, which turns off the device after a set amount of time, for example, 20 minutes, in case a user forgets to shut off the device after completion of an ironing job. Before turning itself off, lights on the graphic heat setting indicator can flash for a set amount of time, for example, 10 seconds, allowing said user the opportunity to stop the shutoff process. Until the lights stop flashing, a user can simply press a button such as, but not limited to, a heat setting button, the regulatory wheel, or a slide control 106, 602 to continue using the ironing device. The device can turn itself off when the lights stop blinking if nothing is pressed or moved.

The device can be of various shapes and sizes, with each arm configured on either side of the joint to fit together when the device is closed. For example, the device may be about 13 inches long when closed and about 26 inches long when opened completely. The device may have dimensions such as approximately 2 inches wide, with each arm being about 0.75 inches deep. In some embodiments, the upper handle can have a slight curve for better ergonomics, thus easier for gripping and increased comfort. In some embodiments, the upper and lower arms complement each other so that they fit together, as illustrated in FIG. 1. In some embodiments, the upper arm 102, 702 and lower arm 104, 708 bow out from each other so that the user grips only the upper arm 102, 702 when using the device in the closed configuration, as illustrated in FIG. 7. Additionally, in some embodiments, the soleplates can be mostly, or completely, rectangular, with the option that they be tapered to a point to facilitate workability around small details in fabric or seams in clothing, as illustrated in FIG. 2. In some embodiments, the soleplates can shaped more like a traditional iron, as illustrated in FIGS. 6-11. As described above, the device, aside from the soleplates, can be made of plastic casing.

Configuration 2

Figure 12:
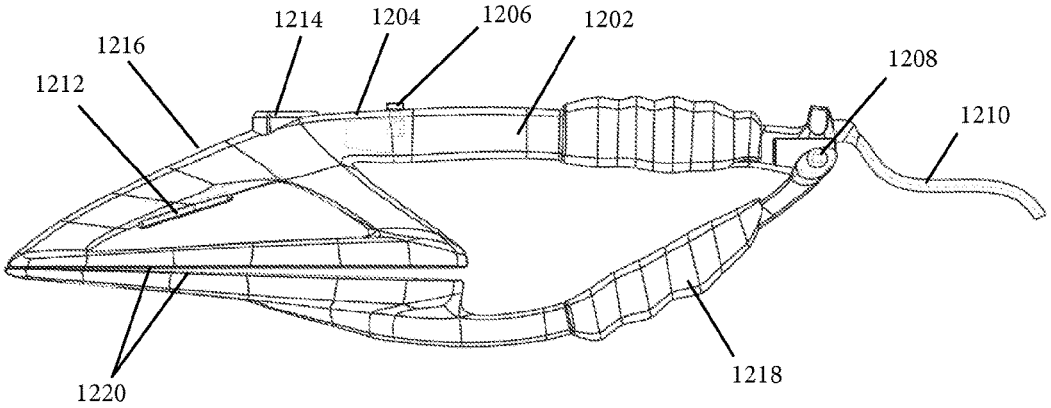
FIG. 12 is a left side view of one embodiment of the ironing device.
Figure 13:
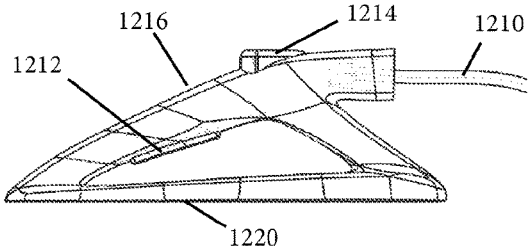
FIG. 13 is a left side view of one embodiment of the ironing device wherein the front of the upper arm of the device is a detachable head.

In one embodiment, the device has the option to be used in a closed position, as described above and as illustrated in FIG. 12, or as a traditional iron where the front of the upper arm of the device is a detachable head, as illustrated in FIG. 13. In this embodiment, the upper arm 1202 and the head joint 1204, which is located on the front part of the upper arm 1202, are designed to avoid rotation about the device's upper arm axis. The head joint 1204 can be held in place with a pin 1206, which in one embodiment is a spring loaded snap joint. The upper 1202 and lower 1218 arms of the device can pivot about a hinge 1208 that is a non-convertible revolute joint. A power cord 1210 can be plugged into an electric contact on the upper arm 1202 and can be easily removed when the head is detached. The power cord 1210 can then be plugged into the head at the site of the head joint 1204.

In one embodiment, the head of the upper portion of the device can be detached and the device can have an on/off button or switch 1212 located under the handle of the head, a steam control button or switch 1214 located on the top portion of the head of the upper portion of the device to provide for a burst of steam when desired, and visible temperature controls/indicator 1216 on the top portion of the head of the upper portion of the device. When the device is turned on, a user can use the device in the closed position to press material using the upper and lower soleplates 1220 or a user can use the device in the traditional iron position, wherein the soleplate on the upper head is used to press various materials.

Configuration 3

Figure 14:
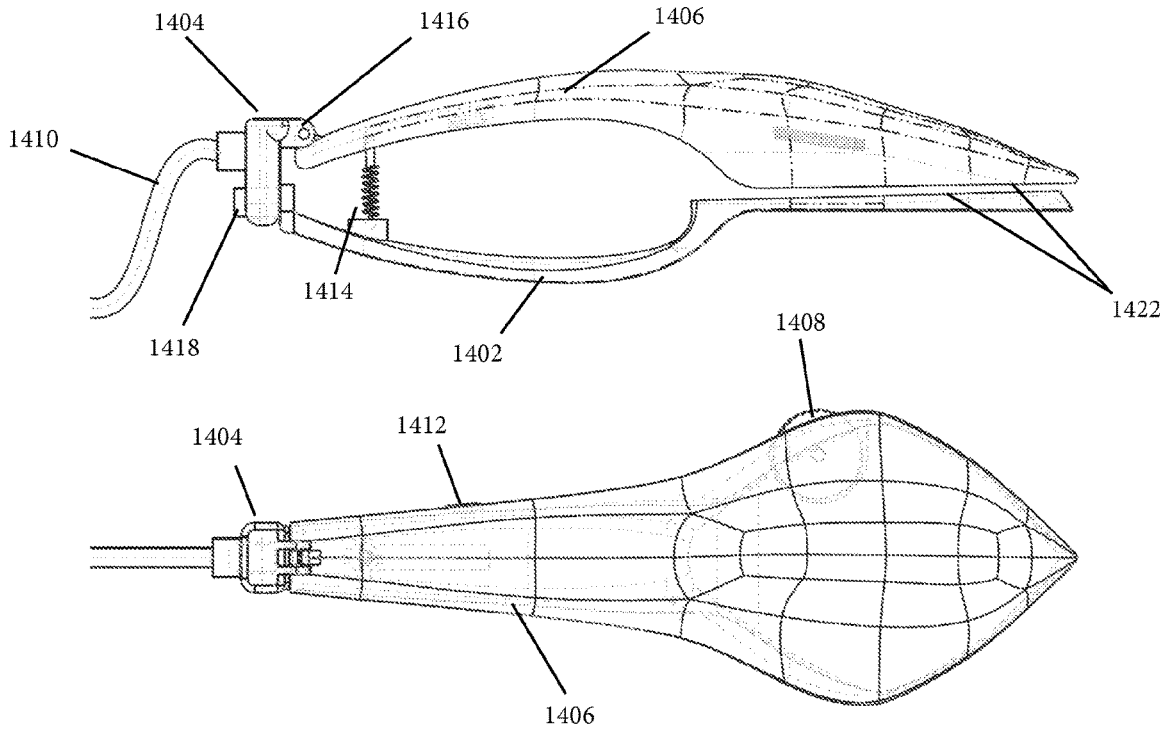
FIG. 14 is a right side view and a top view of one embodiment of the ironing device in the closed position.
Figure 15:
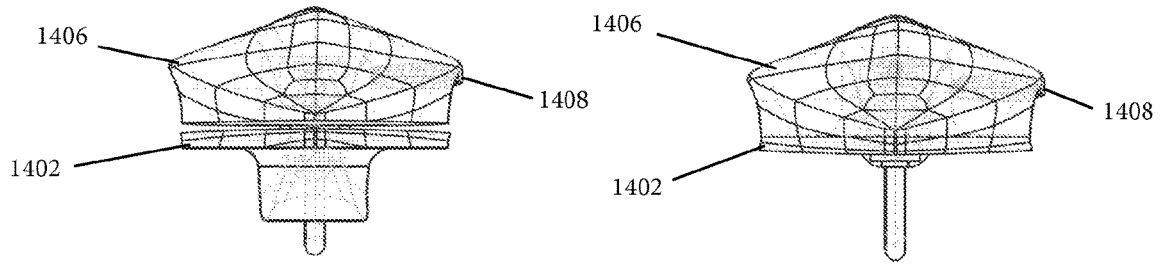
FIG. 15 is a front view of one embodiment of the invention wherein the left drawing depicts the device in the closed position and the right drawing depicts the device after the lower arm has rotated around a swivel hinge and fit directly under the upper arm.
Figure 16:
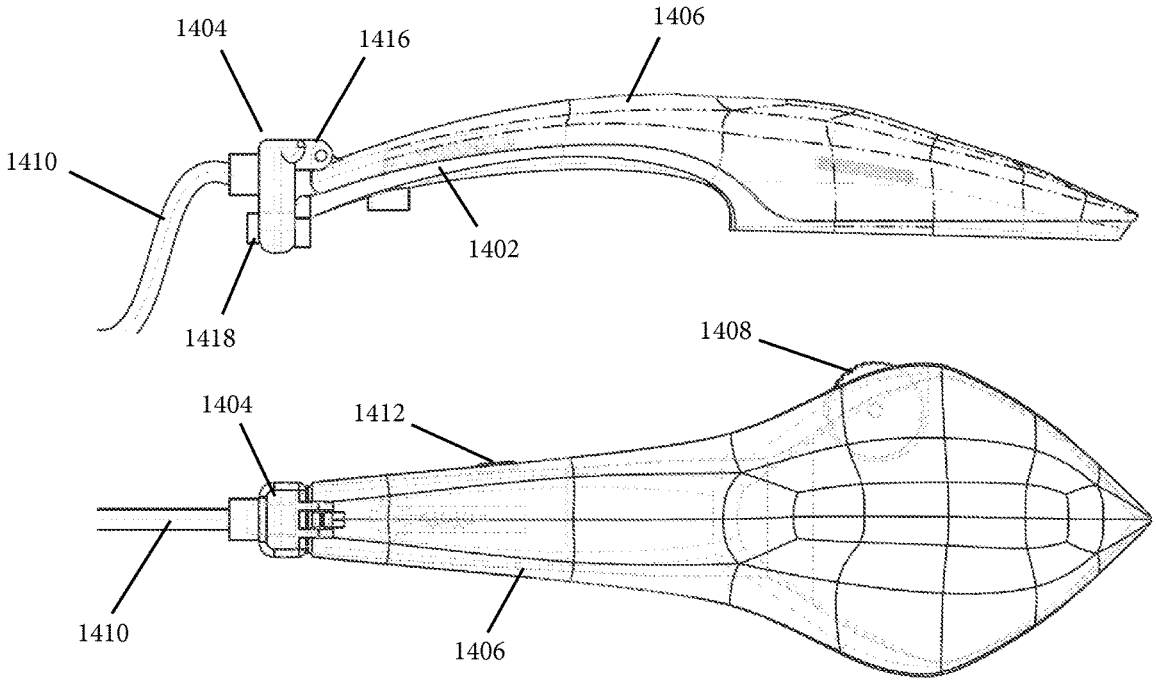
FIG. 16 is a right side view of one embodiment of the ironing device wherein the lower arm has rotated around a swivel hinge and fit directly under the upper arm.

In one embodiment, the device has the option to be used in a closed position, as described above and as illustrated in FIG. 14, or as a traditional iron, wherein the lower arm 1402 rotates around a swivel hinge 1404 connecting the upper 1406 and lower 1402 arms and fits directly under the upper arm 1406, as illustrated in FIGS. 15 and 16. In this embodiment, any electronics, such as the temperature control 1408, and steam functionalities are located on, or in, the upper arm 1406. Additionally, the upper arm 1406 can house the power cord 1410, a power button or switch 1412, and a spring 1414 that is used to provide a flexing action between the arms of the device.

Figure 17:
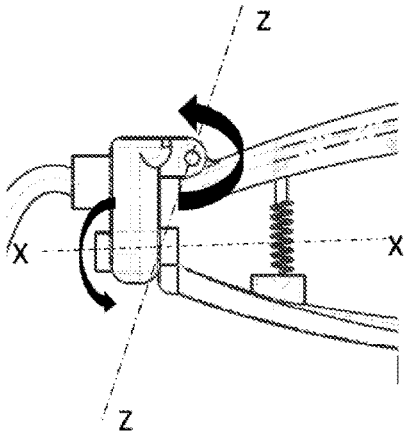
FIG. 17 depicts the axes of rotation around which the lower arm of one embodiment of the invention rotates on a swivel hinge to fit directly under the upper arm.

In this embodiment, the lower arm 1402 is complementary to the upper arm 1406 in a way that the lower portion of the lower arm 1402, which can be covered with a heat-insulating surface, has a complementary profile to the lower portion of the upper arm 1406, as illustrated in FIGS. 15 and 16. The swivel hinge 1404 can be attached to the upper 1406 and lower 1402 arms with an upper revolute joint 1416 and a lower revolute joint 1418, which allows rotation about an axis perpendicular to the axis of rotation of the joint about which the upper arm is pivoted, as illustrated in FIG. 17. This provides for a biaxial swivel mechanism that allows the device to be converted into a traditional iron. The rotation of the lower arm 1402 around the axes automatically disconnects the upper soleplate from electric current. The device then functions similarly to a traditional household iron such that the user grips the upper arm 1406 and applies downward pressure onto the surface to be pressed, with the lower soleplate being heated by an electric current and facing toward the surface, as illustrated in FIG. 16.

When the device is turned on, a user can use the device in the closed position to press material using the upper and lower soleplates 1422 or a user can use the device in the traditional iron position, wherein the lower arm's soleplate is used to press various materials.

Configuration 4

Figure 18:
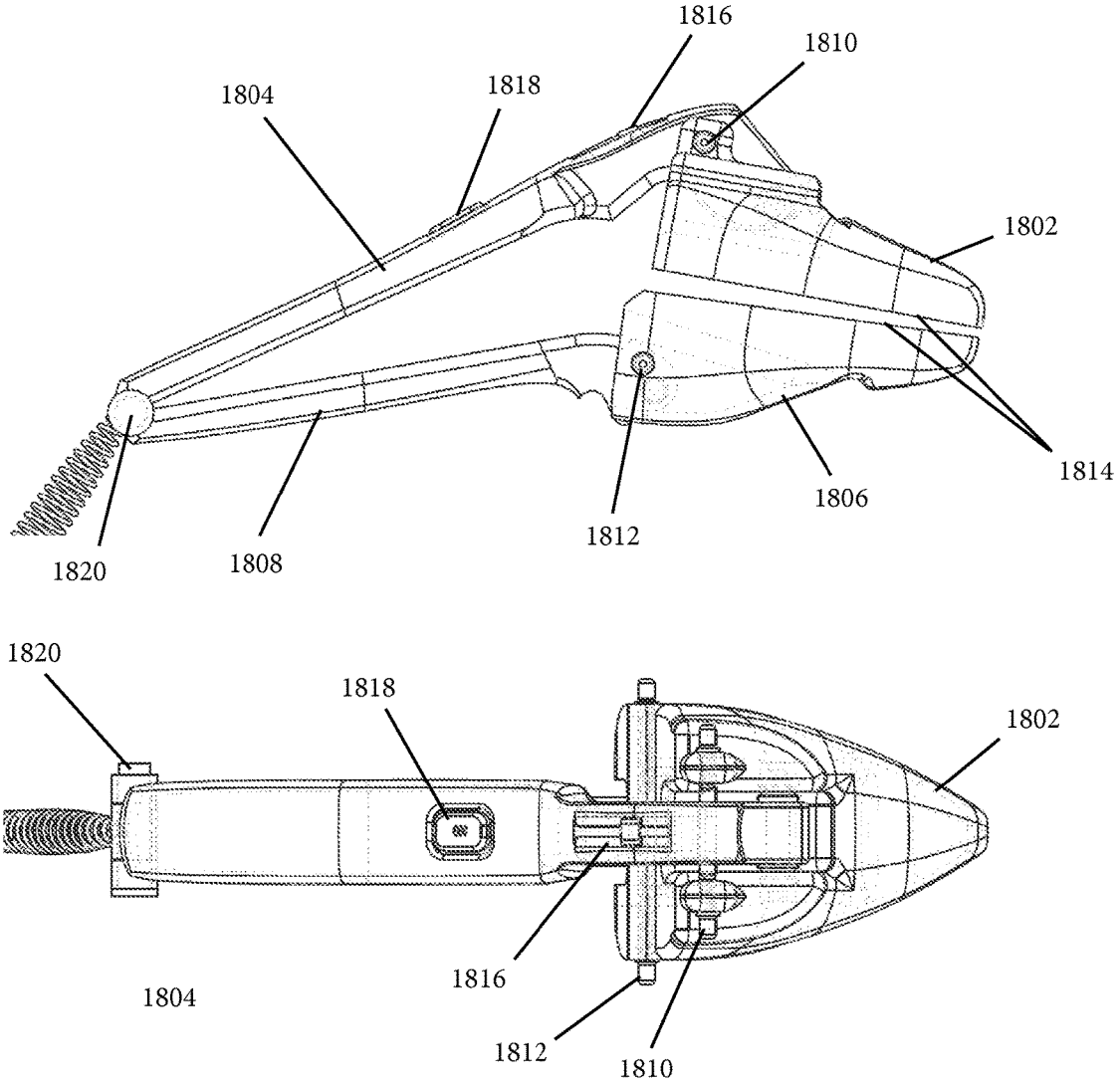
FIG. 18 is a right side view and a top view of one embodiment of the ironing device in the closed position.
Figure 19:
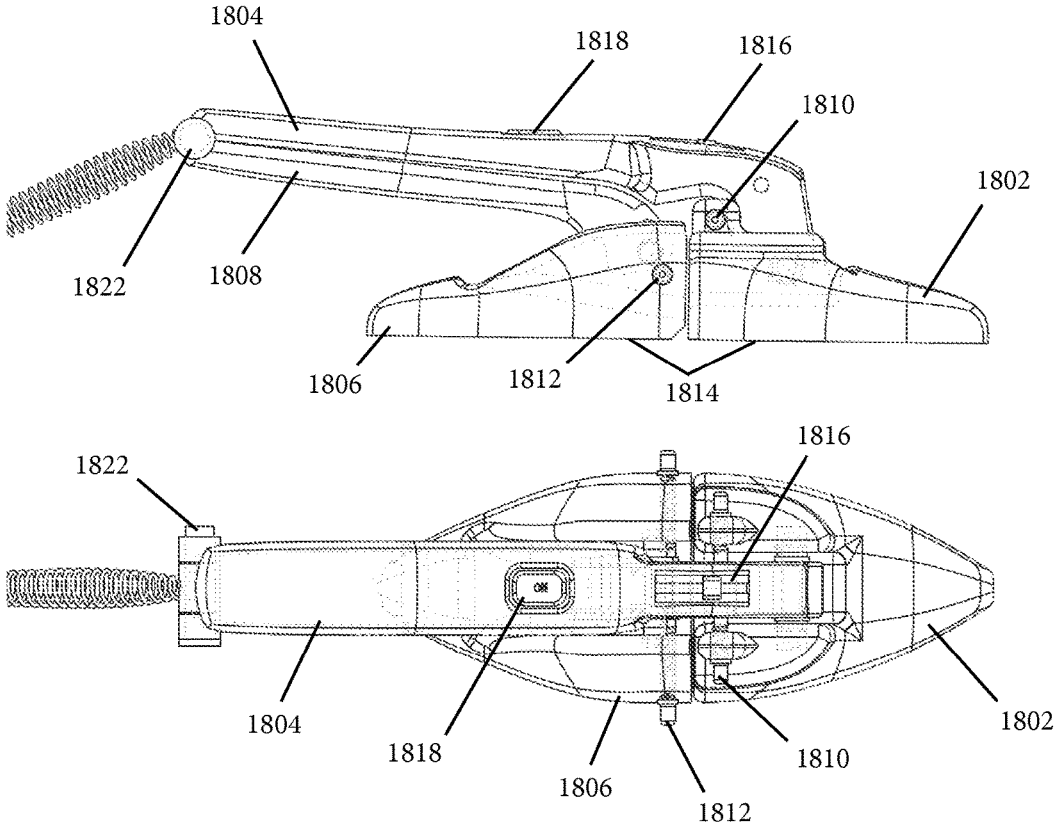
FIG. 19 is a right side view and a top view of one embodiment of the ironing device wherein the upper and lower heads swing about their respective joints and lock into place next to each other so that both soleplates are facing downward in the same direction.

In one embodiment, the device has the option to be used in a closed position, as illustrated in FIG. 18, or as a traditional iron, wherein the upper head 1802 on the upper arm 1804 and the lower head 1806 on the lower arm 1808 swing about the upper joint 1810 and lower joint 1812, respectively, and lock into place next to each other using spring-loaded snap joints so that the upper and lower soleplates 1814 are facing downward in the same direction, as illustrated in FIG. 19. When in the closed position, the upper joint 1810 and lower joint 1812 can be disengaged using the spring so that the upper head 1802 and lower head 1806 swing on their respective head-hinges and can be transformed from the closed version of the device into a traditional iron. Likewise, when in a traditional iron position, the upper joint 1810 and lower joint 1812 can be disengaged using the spring, and the upper head 1802 and lower head 1806 can swing back to the closed position. Temperature controls 1816, steam controls, and the on/off button or switch 1818 can be located on the upper arm 1804 in this embodiment. When the device is turned on using the on/off button or switch 1818, a user can use the device in the closed position to press material using the upper and lower soleplates 1814, or a user can use the device in the traditional iron position by swinging the upper head 1802 and lower head 1806 into a parallel position to press material using the downward-facing upper and lower soleplates 1814. The device can also pivot where it connects to the power cord using a pivot-hinge 1820.

The various embodiments described above are provided by way of illustration only and should not be construed to limit the claimed invention. Those skilled in the art will readily recognize various modifications and changes that may be made without following the example embodiments and applications illustrated and described herein and without departing from the true spirit and scope of the claimed invention.

What is claimed is:

1. An electrically-powered ironing device comprising:
a first arm with a proximal end and a distal end;
a second arm with a proximal end and a distal end;
a first heat conducting soleplate at the distal end of the first arm heated by a first heating element;
a second heat conducting soleplate at the distal end of the second arm heated by a second heating element;
a power cord connected at the proximal end of at least one of the first arm or the second arm;
a hinge;
an on button;
an off button;
wherein:
the first arm and the second arm are connected via the hinge at their proximal ends; and
the first arm and second arm are structured and configured to rotate 360 degrees at their connected, proximal ends.

2. The ironing device of claim 1, wherein the device is further comprised of a water reservoir and steam control.

3. The ironing device of claim 1, further comprising:
temperature controls;
a temperature sensor;
a power driver; and
a current sensor;
wherein:
the first heating element is on and the second heating element is on when the on button is pressed and the first heat conducting soleplate and the second heat conducting soleplate are facing each other; and
the first heating element is on and the second heating element is off when the on button is pressed and the second arm has been moved away from the first arm.

4. The ironing device of claim 1, wherein the first arm is removable from the second arm.

5. An electrically-powered ironing device comprising:
a first arm with a proximal end and a distal end;
a second arm with a proximal end and a distal end;
a first heat conducting soleplate at the distal end of the first arm heated by a first heating element;
a second heat conducting soleplate at the distal end of the second arm heated by a second heating element; and
a power cord;
wherein:
the first arm and the second arm are connected via the hinge at their proximal ends;
at least a portion of the first arm is removable from the rest of the device;
the removable portion of the first arm includes at least a gripping portion of the first arm, the first heat conducting soleplate, and the first heating element; and
the removable portion of the first arm is enabled to function as an iron.

6. The ironing device of claim 5, wherein the power cord is connectable to the removable portion of the first arm.

7. The ironing device of claim 1, wherein a bottom surface of the second arm complements a bottom surface of the first arm.

8. The ironing device of claim 7, wherein the second arm is enabled to rotate to create a complementary fit underneath the first arm.

9. An electrically-powered ironing device comprising:
a first arm with a proximal end and a distal end;
a second arm with a proximal end and a distal end;
a first heat conducting soleplate at the distal end of the first arm heated by a first heating element; and
a second heat conducting soleplate at the distal end of the second arm heated by a second heating element;
wherein:
the first and second arms each have a rotatable head at the distal end of their arms,
the upper soleplate is attached to the upper rotatable head,
the lower soleplate is attached to the lower rotatable head, and
the heads are rotatable from a stacked position with the soleplates facing each other to a side-by-side position with the soleplates facing the same direction.

* * * * *